US005842741A

United States Patent [19]

Onorini

[11] Patent Number: 5,842,741

[45] Date of Patent: Dec. 1, 1998

[54] DUROSWING

[76] Inventor: Giorgio Onorini, 5155 York Ct., Cape Coral, Fla. 33904

[21] Appl. No.: 669,024

[22] Filed: Jun. 24, 1996

[51] Int. Cl.[6] ..... A63G 9/00

[52] U.S. Cl. ..... 297/281; 472/125; 297/273

[58] Field of Search ..... 297/273, 281, 297/282; 472/118, 125

[56] References Cited

U.S. PATENT DOCUMENTS

| | | | |
|---|---|---|---|
| 375,096 | 12/1887 | Ransweiler | 297/281 |
| 654,779 | 7/1900 | Bowland | 472/125 |
| 2,095,636 | 10/1937 | Hardy | 297/282 |
| 2,679,893 | 6/1954 | Bennett | 297/282 |
| 5,564,987 | 10/1996 | Ayrolles | 472/125 X |

FOREIGN PATENT DOCUMENTS

| | | | |
|---|---|---|---|
| 1252354 | 12/1960 | France | 297/273 |

*Primary Examiner*—Peter R. Brown

*Attorney, Agent, or Firm*—Mills & Assoc.

[57] ABSTRACT

An improved portable patio swing of the type being suspended from a free-standing, overhead support frame. The patio swing includes a swing seat including a sling cushion that is suspended within a peripheral seat frame including a pair of opposed, S-shaped arm members being interconnected by seat frame cross-members. The sling cushion features a plurality of articulating compartments formed therein which are capable of folding across the width thereof to conform to the back and rear end of the occupant of the swing. The swing seat is suspended within the overhead support means by predetermined lengths of linked chain or other suitable connecting means which position the swing seat at the desired inclination in relation to the supporting frame. The overhead supporting frame is generally rectangular in configuration and includes a pair of opposed stabilizing legs having a long leg portion and a short leg portion which are adapted to balance the load exerted as the center of gravity shifts during operation of the swing. The swing includes an optional canopy to provide shade for the occupants thereof and an optional footrest which depends from said swing seat.

7 Claims, 2 Drawing Sheets

DUROSWING

This application claims the benefit of U.S. Provisional Application No. 60/001,952 filed Aug. 7, 1995 by Giorgio Onorini.

BACKGROUND OF INVENTION

1. Field of the Invention

This invention relates to patio swings and, more particularly, to a portable patio swing that is suspended from an overhead frame.

Recreational swing gliders for use on a patio or porch are well known to those skilled in the art.

In the conventional practice, the swing seat is suspended from an overhead frame comprised of side frame members including elongated, vertical columns and an overhead crossbar member extending therebetween and being fixedly attached thereto.

Such a swing glider generally includes a suspension system for supporting the swing seat from the side frame members and for adjusting the inclination of the side frame members to recline the swing seat to a comfortable position.

Typically, the swing gliders of the prior art are comprised of numerous components and, thus, are difficult to assemble, cumbersome to transport, and expensive to manufacture.

The present invention provides a solution to these problems by providing a portable swing glider having fewer component parts and, thus, is relatively simple to assemble and is less expensive to manufacture.

2. Description of Related Art

U.S. Pat. No. Des. 355,982 to Carl V. Matthews, Sr. discloses the ornamental design for a patio swing including a support frame having a pair of vertical uprights and curved arm rests.

U.S. Pat. No. Des. 99,733 to Milton B. Smith discloses the ornamental design for a canopy glider being mounted on a peripheral frame of tubular construction having a canopy mounted thereon.

U.S. Pat. No. Des. 313,513 to Janet L. Girecky et al, discloses the ornamental design for a swing seat including a generally rectangular supporting frame having curved side rails in which the swing seat is suspended.

U.S. Pat. No. Des. 349,819 to Robert C. Noll discloses the ornamental design for a swing including a supporting frame having a pair of generally triangular side frame members of tubular construction interconnected by cross members wherein the swing is suspended.

U.S. Pat. No. Des. 356,215 to Ronald D. Newman discloses the ornamental design for a porch swing having a generally rectangular seat frame with side arm rests wherein a sling-type seatback is suspended.

U.S. Pat. No. 1,346,973 to Patrick W. Padden discloses a swing having a support frame including single uprights in the upper portion thereof with an overhead rod suspending the swing seat.

U.S. Pat. No. 4,917,378 to Janet L. Girecky et al, discloses a recreational swing unit comprised of a lounge swing adapted to be supported by chains from an overhead support structure.

U.S. Pat. No. 1,944,446 to William R. McGowen discloses a swing including a pivoting foot rest that is designed to be suspended by chains from an overhead support member.

U.S. Pat. No. 1,984,786 to Henri Dujardin discloses an adjustable chair having a sling-type seatback that is suspended within a peripheral frame.

U.S. Pat. No. 4,221,429 to Mark W. Wade discloses a suspended recliner that is provided with a leg support area which depends vertically downward from the main body of the recliner.

U.S. Pat. No. 4,838,609 to Daniel R. Christensen discloses a swing couch comprised of a generally rectangular support frame wherein a slingtype seatback is suspended.

U.S. Pat. No. 5,058,971 to Lawrence A. Thiel discloses a reclineable swing chair which is suspended from cables or chains, or similar flexible rope or linked bars.

U.S. Pat. No. 5,153,955 and U.S. Pat. No. 5,224,225 a continuation-in-part thereof to Albert L. Singleton, Jr. et al. discloses a hammock stand consisting of three sections for suspending a hammock above the ground.

The printed publication, *Brookstone—Hard to Find Tools,* 1995, on page 71 discloses a double swing chair that is similar in appearance to the present invention.

The printed publication, *Home Decorators Collection,* Winter, 1995, on page 47 discloses a Hammock Chair Stand that is similar in appearance to the present invention.

SUMMARY OF THE INVENTION

After much research and study in the art, the present invention has been developed to provide a portable patio swing which is suspended within a free-standing overhead frame. The swing seat includes a flexible sling cushion forming the seat well and seat back which is suspended within a peripheral seat frame having a pair of S-shaped side arm members.

The sling cushion is comprised of a plurality of articulating panels which conform to the back and rear of a person seated therein to provide comfortable support.

The swing is suspendable from an overhead support frame which, in accordance with the present invention, includes a crossbar fixedly attached to a pair of vertically opposed columns, each being supported by a perpendicular leg portion. The opposed leg portions are interconnected by a lower horizontal crossbar and reinforced with corner braces to provide added support and to balance the swing during operation.

The portable patio swing is provided with an optional canopy to provide protection from the harmful effects of the sun and to give shade to the users thereof.

In view of the above, it is an object of the present invention to provide a portable patio swing which may be suspended from a free-standing overhead frame.

Another object of the present invention is to provide an overhead frame supported by stabilizing legs being adapted to balance the swing as its center of gravity shifts during operation.

Another object of the present invention is to provide a sling cushion type of seat that includes a plurality of articulating panels that conform to the back and rear of person sitting therein to provide comfortable support.

Another object of the present invention is to provide a portable patio swing with a suspended foot rest.

Other objects and advantages of the present invention will become apparent and obvious from a study of the following description and the accompanying drawings which are merely illustrative of such invention.

DESCRIPTION OF THE PREFERRED EMBODIMENT

Figure 1:
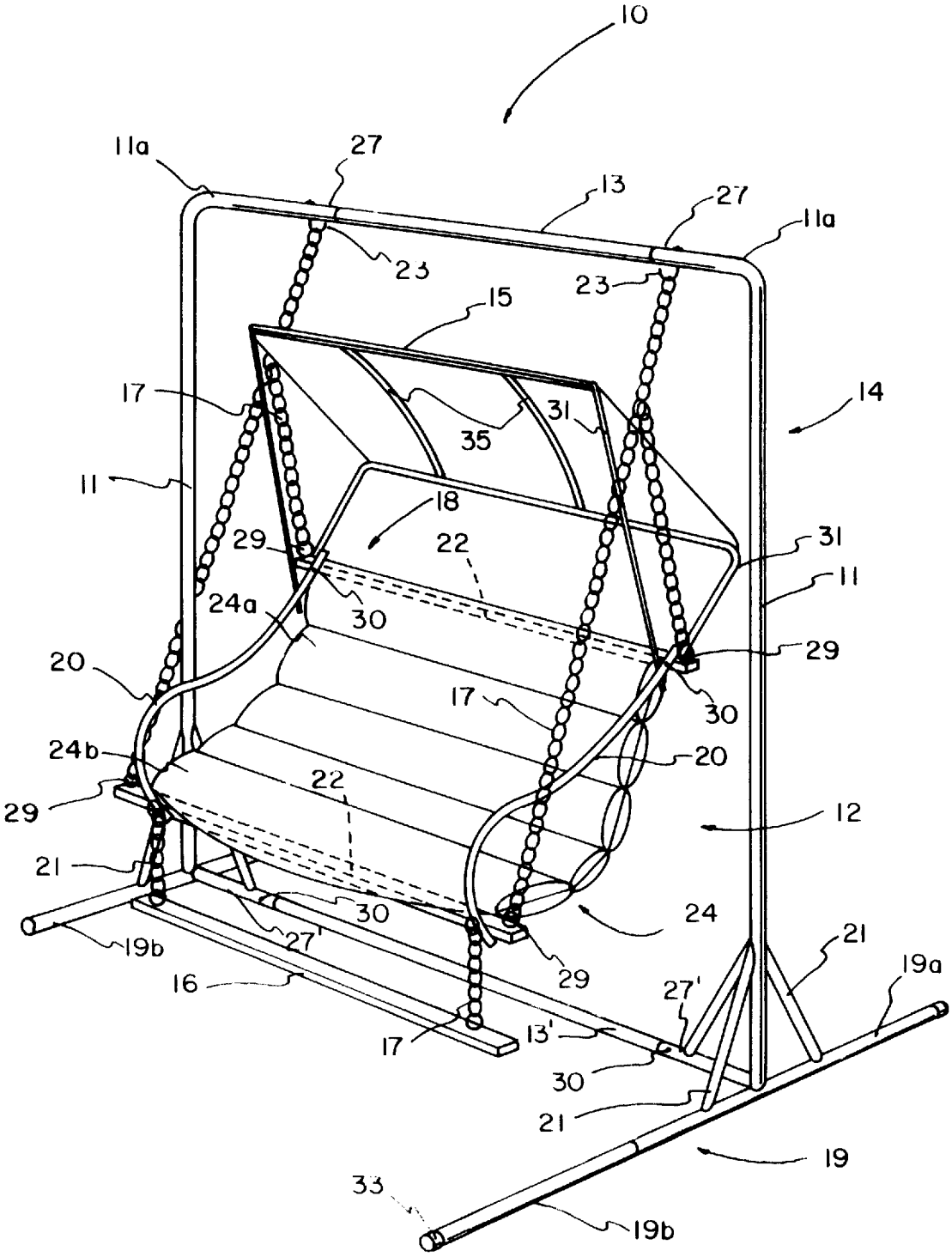
FIG. 1 is a perspective view of the portable patio swing of the present invention.

With further reference to the drawings, a portable patio swing in accordance with the present invention is illustrated in FIG. 1 and indicated generally at 10.

The major components of the patio swing 10 are the swing seat, indicated generally at 12, and the overhead support frame, indicated generally at 14.

In the embodiment shown, swing seat 12 is provided with an optional canopy 15 which is adapted for removable attachment thereto. Swing seat 12 is also provided with an optional foot rest 16 which depends therefrom by linked chain 17 as shown in FIG. 1.

Swing seat 12 includes a seat frame, indicated generally at 18, including a pair of S-shaped arm members 20 which are adapted for attachment at the terminal ends thereof to a pair of parallel, seat cross members 22.

In the preferred embodiment, arm members 20 and cross members 22 are fabricated from fiberglass or other suitable materials.

It can be seen that the swing seat 12 is provided with a sling cushion, indicated generally at 24, which is adapted for removable attachment at either end thereof to seat cross members 22 thereby forming a seatback 24*a* and a seat well 24*b*.

Figure 2:
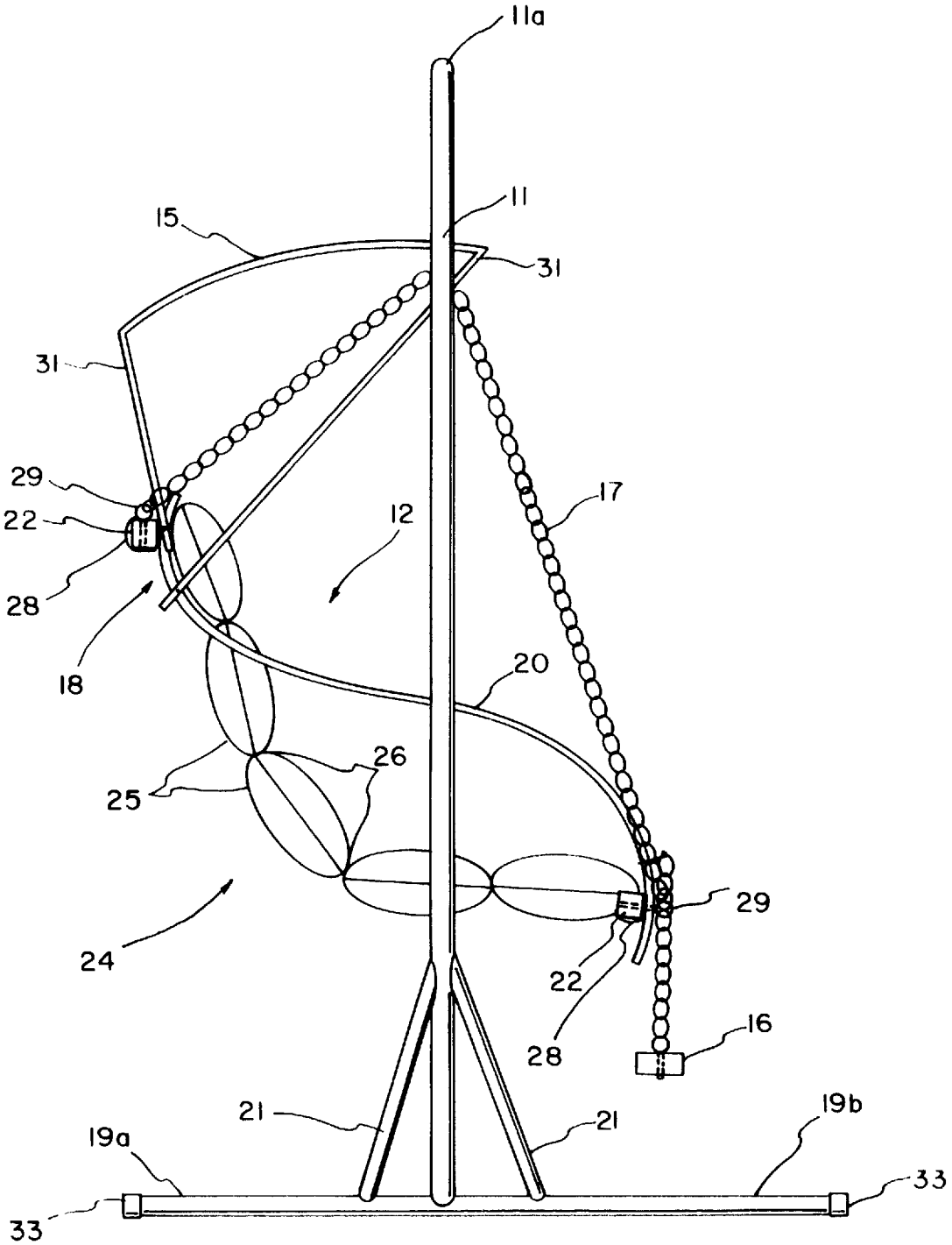
FIG. 2 is a side elevational view of the patio swing showing the articulating compartments formed in the sling cushion.

Turning now to FIG. 2, sling cushion 24 includes a plurality of horizontally disposed, articulating compartments 25 therein which conform to the shape of a person (not shown) occupying the swing seat 12.

In the preferred embodiment, the sling cushion 24 may be fabricated from an acrylic fabric suitable for use outdoors such as that sold under the tradename Sunbrella. Sling cushion 24 is fabricated by stitching together opposed sheets of a suitable material to form an elongated envelope which is filled with a marine dacron or other suitable filler material such as an expanded foam.

Thereafter, sling cushion 24 is stitched across its breadth along stitching lines 26 to form the plurality of horizontally disposed, articulating compartments 25.

The upper and lower ends of sling cushion 24 are adapted for attachment to seat cross members 22 in order to suspend the sling cushion 24 within seat frame 18.

In the preferred embodiment, the upper and lower ends of cushion 24, have formed therein a pocket 28 extending the width of sling cushion 24 which are each adapted to receive a corresponding seat cross member 22 thereby permanently retaining sling cushion 24 therebetween.

Thus, in an assembly procedure for swing seat 12, seat cross members 22 will be inserted into pockets 28 such that the terminal ends thereof protrude slightly from either end.

S-shaped arm members 20 may be fixedly attached at either end thereof by machine screws 30 extending through apertures (not shown) formed in either end of S-shaped arm members 20 and seat cross members 22.

Referring again to FIG. 1, the swing seat 12, as assembled, is suspended from an overhead support frame 14 by linked chain 17 or other suitable connecting means.

In the preferred embodiment, predetermined lengths of chain 17 are coupled to eye bolts 29 which are fixed to seat cross members 22 as shown in FIG. 1.

The predetermined lengths of chain 17 are arranged to suspend the swing seat 12 at the desired inclination in relation to overhead support frame 14.

Overhead support frame 14 includes a pair of vertically opposed upright members 11 which are interconnected by a pair of horizontally disposed upper and lower cross-bars 13 and 13' being fixedly attached at their terminal ends by a slip joint connection as at 27 and 27', respectively.

Since such slip joint connections are well known to those skilled in the art, further detailed discussion of the same is not deemed necessary.

It can be seen that the lower ends of each respective upright member 11 are attached to opposed, stabilizing legs, indicated generally at 19, which are disposed in perpendicular relation to upright members 11 in order to stabilize the same during operation of the swing 10.

Stabilizing leg 19 includes a short leg portion 19*a* and a long leg portion 19*b* which are fabricated to a predetermined length and adapted to balance the load when swing 10 is occupied and the center of gravity of the same is shifted during operation.

In the preferred embodiment, frame members 11, 13 and 19 are formed from tubular steel or other suitable material and are painted for durability and capped to prevent water damage as at 33.

Still referring to FIG. 1, it can be seen that the upright members 11 are reinforced by corner braces 21 at their juncture with stabilizing legs 19 and the lower horizontal cross bar 13' in order to provide adequate support for upright members 11.

In the preferred embodiment, a plurality of corner braces 21 extend from stabilizing legs 19 and lower horizontal cross-bar 13' and being attached thereto by weldment or other suitable means to provide additional strength to the overhead frame 14.

In the embodiment shown, swing seat 12 is suspended from a pair of J-shaped hooks 23, which are fixedly attached to the curved, inwardly projecting portions 14*a* of upright members 11.

Swing seat 12 may be provided with an optional canopy 15 for shade. In the embodiment shown, a generally rectangular canopy 15 is pivotally mounted between a pair of generally U-shaped rod members 31 which are adapted for attachment to the upper ends of S-shaped arm members 20 by machine screws 30 or other suitable fasteners.

Canopy is provided with a plurality of flexible plastic spreaders 35 to maintain canopy in the arched configuration shown in FIG. 2.

From the above it can be seen that the portable patio swing of the present invention provides significant improvements over the swing gliders of the prior art.

The portable patio swing of the present invention features a sling-type cushion including a plurality of articulating compartments which conform to the back and rear of the occupant of the swing.

In addition, the portable patio swing of the present invention provides a free-standing overhead support frame including stabilizing legs which are adapted to balance the load of the swing as the center of gravity is shifted during operation.

Finally, the improved patio swing of the present invention features a seat frame fabricated from durable, weatherproof materials and having a reduced number of components so as to be relatively inexpensive to manufacture and easy to assemble. Suspended therebelow is a foot rest for greater comfort.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An improved portable patio swing of the type being suspended within a free-standing, overhead support frame, said improvements comprising:

a swing seat means including a pair of horizontally opposed, S-shaped arm members, said arm members being interconnected by a plurality of cross-members fixedly attached at the terminal ends thereof forming a peripheral seat frame means, said swing seat means further including a sling cushion means disposed between said S-shaped arm members and being adapted for attachment at either end thereof to said cross-members in the manner of a sling, said sling cushion means including a plurality of generally rectangular, horizontally disposed articulating compartments integrally formed therein whereby each respective articulating compartment within said sling cushion means may be folded across the width thereof to conform to the shape of the occupant of said swing; and overhead support frame means whereon said swing seat means is suspended by connecting means, said frame means including a pair of vertically opposed, upright members interconnected by a pair of horizontally disposed upper and lower cross-bar members being fixedly attached at the terminal ends thereof, each of said upright members also being fixedly attached at lower end thereof to a stabilizing leg, said stabilizing leg including a short leg portion and a long leg portion adapted to balance the load exerted thereon during operation of said swing.

2. The swing of claim 1 wherein said plurality of articulating compartments within said cushion means are formed by stitching the opposed surfaces of the same along parallel lines across the width thereof at predetermined intervals.

3. The swing of claim 1 wherein said connecting means includes predetermined lengths of linked chain arranged to suspend said swing seat means at a specific inclination in relation to said overhead frame means.

4. The swing of claim 1 wherein said overhead support frame means is fabricated from tubular steel.

5. The swing of claim 1 including a canopy means being pivotally mounted on said seat frame means to provide shade for an occupant of said swing.

6. The swing of claim 1 including a footrest means depending from said swing seat means.

7. The swing of claim 1 wherein each of said pair of upright members are corner braced to both said short leg portion and said long leg portion of each of the stabilizing legs attached to each of said pair of upright members and to the lower cross-bar member.

* * * * *